United States Patent [19]

Burgess

[11] Patent Number: 4,470,901

[45] Date of Patent: Sep. 11, 1984

[54] SYSTEM FOR CONTROLLING SEPARATING GRAVITY IN DENSE-MEDIA CYCLONE

[75] Inventor: Curtis L. Burgess, Bethlehem, Pa.

[73] Assignee: Bethlehem Steel Corp., Bethlehem, Pa.

[21] Appl. No.: 402,495

[22] Filed: Jul. 28, 1982

[51] Int. Cl.[3] ..... B03B 13/00; B03B 5/34

[52] U.S. Cl. ..... 209/1; 209/172.5

[58] Field of Search ..... 209/211, 172.5, 1, 39; 210/96.1

[56] References Cited

U.S. PATENT DOCUMENTS

| | | | |
|---|---|---|---|
| 3,687,284 | 8/1972 | Leeman et al. | 209/172.5 |
| 4,028,228 | 6/1977 | Ferris et al. | 209/172.5 |
| 4,276,119 | 6/1981 | Karnis et al. | 209/211 |

OTHER PUBLICATIONS

*Chemical Engineers' Handbook*, R. M. Perry, C. H. Chilton, 5th Edition, McGraw-Hill, New York, NY, pp. 22-3,4; 22.12-22.21.

*Primary Examiner*—Frank W. Lutter
*Assistant Examiner*—William Bond
*Attorney, Agent, or Firm*—John I. Iverson; William B. Noll

[57] ABSTRACT

This invention is directed to a method of beneficiating a material, such as coal, by subjecting the coal to be treated to the action of a dense-media cyclone, where the dense-media thereof is a slurry of magnetite in water. More particularly, the present invention relates to a method to control the separating gravity of said cyclone within predetermined limits by (1) measuring the flow rate and percent magnetite in the flow discharging from the cyclone, and (2) based on pre-calibrated data, adjusting the feed flow and content, i.e. magnetite and/or water, into said cyclone, thereby controlling said separating gravity within predetermined limits.

2 Claims, 2 Drawing Figures

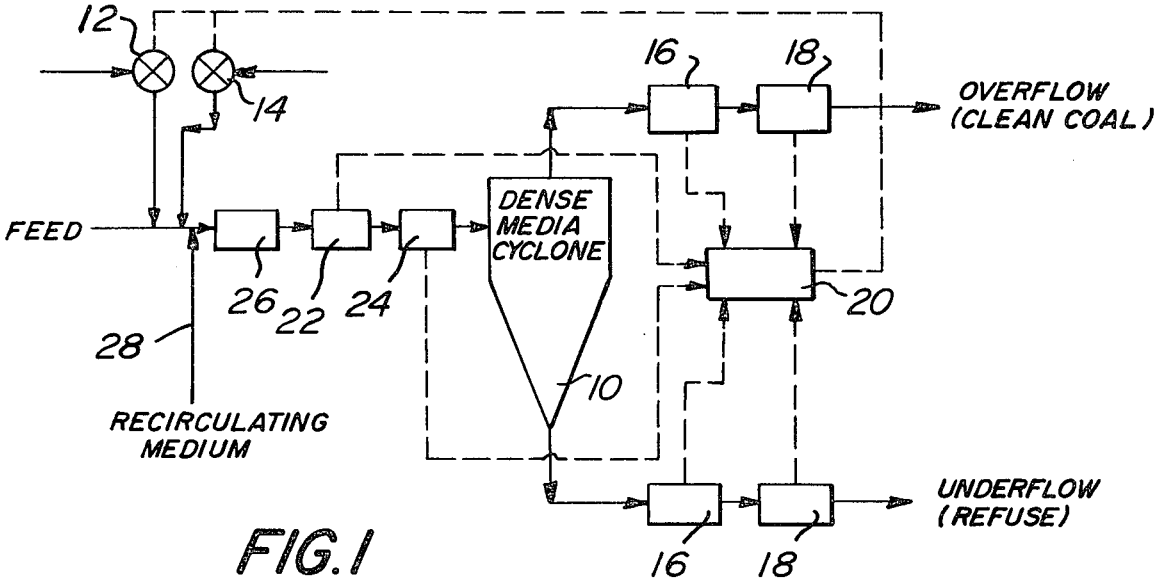
FIG. 1
FIG. 2
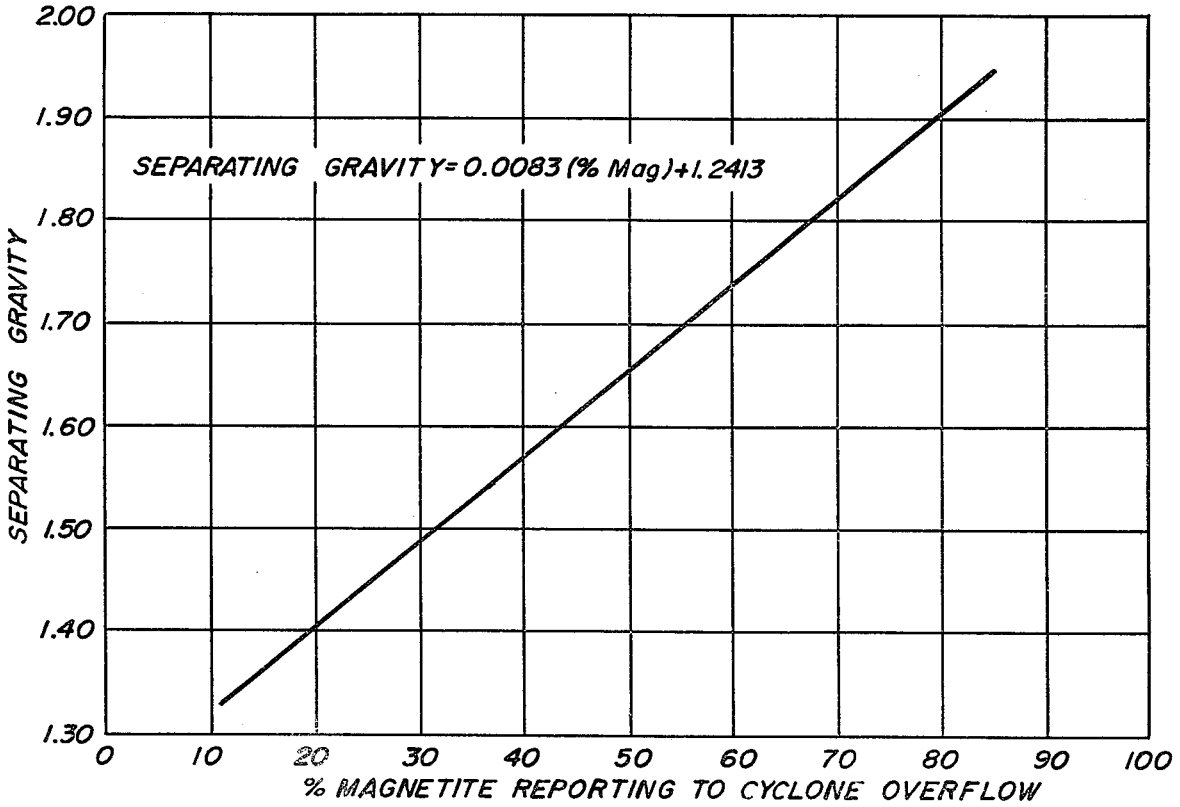

SYSTEM FOR CONTROLLING SEPARATING GRAVITY IN DENSE-MEDIA CYCLONE

BACKGROUND OF THE INVENTION

The present invention is directed to a method of beneficiating material, such as coal, by the sink-and-float process utilizing a dense-media cyclone. More particularly this invention relates to such method in which the separating gravity of the dense-media cyclone is controlled to insure the optimum beneficiation of the treated material.

The use of dense-media separators for segregating material according to its specific gravity is well known in the material separating art, such as the processing of coal. In these separators, a dense-media formed of a finely divided high gravity solid, such as magnetite, suspended in water, is maintained within a vessel, i.e. cyclone. The material or coal to be separated is introduced into the dense-media, and the material or coal which has a specific gravity less than the specific gravity of the suspension reports to the cyclone overflow. For convenience, the coal may be termed the overflow. Material or refuse which has a specific gravity greater than the suspension reports to the cyclone underflow. Thus, the sink material may be termed the underflow.

By the very nature of this beneficiating process, the coal and refuse, overflow and underflow respectively, entrain a certain quantity of the magnetite which must be removed from the coal if the coal is to be thoroughly cleaned for commercial use. Further, recovery of the magnetite, which may be re-used in the process, is necessary for an efficient and economical process. While the present invention relates solely to the primary separation of the coal from the refuse, the magnetite recovery step suggests a further feature of the process, and that is the need to replenish the dense-media suspension. In replenishing the suspension care must be taken to insure a suitable specific gravity within predetermined limits in the cyclone to achieve the primary separation.

A conventional method of controlling the specific gravity of the separating vessel has been for the operator to check the specific gravity of samples of the dense-media at regular intervals and manually make adjustments based on such checks. Another method involves measuring the specific gravity of the media continuously as it enters the vessel and adding water or magnetitie when necessary. Such methods, even when automated, had disadvantages.

U.S. Pat. Nos. 3,246,750 and 3,247,961 (Chase et al), each entitled, "Method and Apparatus for Controlling Specific Gravity in a Heavy Medium Process," teach a system for separating mineral particles, such as coal, which system in part includes "measuring a specific gravity representative of the suspension in the vessel." Based on this measuring, adjustments are made to bring the vessel's specific gravity within predetermined limits.

Controls for the systems described in the above patents rely upon the need to maintain a constancy within the cyclone to obtain an optimum classification of products therefrom.

The present invention represents a unique approach to obtaining a precise separating gravity in a dense-media cyclone using magnetite-water as the slurry therein. Specifically, this invention resulted from the recognition in the processing of coal that there is a correlation between the quantity of magnetite in the cyclone overflow and the separating gravity of the cyclone. The manner by which such recognition has been incorporated into the system of this invention will be described in the following specifications.

SUMMARY OF THE INVENTION

This invention relates to a method of beneficiating a material, such as coal, by subjecting the coal to be treated to the action of a dense-media cyclone, where the dense-media thereof is a slurry of magnetite in water. Since, as discovered herein, the separating gravity in a dense-media cyclone is a function of the distribution of the magnetite between the overflow and underflow discharging from the cyclone, the present method controls the separating gravity of the cyclone within predetermined limits by (1) measuring the flow rate and percent magnetite in the overflow, for example, discharging from the cyclone, and (2) based on pre-calibrated data, adjusting the feed flow and content of additional magnetite and/or water, into the cyclone, thereby reestablishing said separating gravity to within predetermined limits.

BRIEF DESCRIPTION OF DRAWINGS

FIG. 1 is a schematic diagram of a dense-media cyclone circuit incorporating means for controlling the separating gravity in said cyclone according to this invention.

FIG. 2 is a graph illustrating the relationship between the separating gravity of a dense-media cyclone, and the percent magnetite in the overflow from said cyclone.

DETAILED DESCRIPTION OF PREFERRED EMBODIMENT

This invention is directed to a method of beneficiating material, such as coal, by the gravimetric process. It should be understood that such process is merely one of several steps in the beneficiation of material. That is, the overall process may include (1) particle sizing, (2) cyclone separation, and (3) washing and screening, prior to obtaining usable material. While each step involves specific technologies, the present invention is directed only to the intermediate step noted above.

Turning now to such intermediate step with particular reference to FIG. 1, typically raw coal (feed) is directed into a dense-media separator or cyclone 10 which utilizes the specific gravity of the media to separate refuse from the coal. In the case of coal, a slurry of coal, magnetite and water, is fed into cyclone 10. Make-up magnetite valve 12 and make-up water valve 14 are continuousy adjusted, in a manner to be described hereinafter to provide a feed density greater than 1.00. Such feed density is monitored by meter 26 while the flow rate and percent magnetite of the feed are monitored by meters 22 and 24, respectively.

In operation, controlled amounts of magnetite and water are added to the cyclone 10 to achieve a separating gravity within prescribed limits, typically 1.30 to 2.00. Separating gravity as used herein means the specific gravity at which a particle has an equal chance of reporting to overflow or underflow, or where 50% of the particles that have a specific gravity equal to the separating gravity report to the overflow and 50% to the underflow.

The present invention is based on the discovery that the separating gravity in a dense-medium cyclone, in which water and magnetite are mixed to form the slurry feed to the cyclone, is a function of the distribution of the magnetite between the overflow and underflow. That is, by measuring the flow rate and percent magnetite in one or each of these streams, the percent reporting to either the overflow or underflow can be determined. FIG. 2, for example, is a graph showing the relationship of the separating gravity in the cyclone versus the percent magnetite in the overflow. Thus, by monitoring the respective streams from the cyclone changes in the percent magnetite may be readily observed and appropriate changes made to the feed of water and magnetite to the cyclone.

The monitoring of the change in magnetite and the appropriate changes to the feed make-up can be accomplished automatically. Referring again to FIG. 1, after the overflow, i.e. clean coal, and the underflow, i.e. refuse, leave the cyclone 10 a flow meter 16 and a coil 18 measure the flow rate of slurry in GPM and percent magnetite in each respective stream. These measurements are transmitted to a micro-processor 20 which calculates the percent magnetite and compares it to a pre-calibrated curve to determine the separating gravity. If corrections are required the microprocessor 20 transmits a signal to the appropriate valve 12,14 to add magnetite or water, whichever is required to change the separating gravity. Simultaneously, a flow meter 22 and coil 24 on the feed measure the GPM of slurry and percent magnetite. These measurements are transmitted to the micro-processor 20 for comparison with the previously calculated values. Finally, a density gauge 26 may be incorporated into the system to monitor the feed density and to control the amount of non-magnetic material, i.e. water, being circulated.

As reported earlier in describing the general operation of a dense media cyclone, recovery of the magnetite from the overflow and underflow is vital to an economic operation. By recovering the magnetite it is possible to reuse same in the system. Accordingly, recirculating means 28 are provided for supplying or delivering the recovered magnetite for reuse in the system of this invention. Thus, the input or material feed to the cyclone is derived from several sources. The non-magnetites, i.e. raw coal to be cleaned has been designated "Feed" in FIG. 1. Recirculated magnetite, and water, since the magnetite is not in a dry state, are fed to the cyclone by means 28. Finally, since magnetite recovery from the cleaned coal and refuse is not 100%, make-up magnetite and water are introduced into the cyclone by valves 12 and 14.

The method of this invention may be illustrated best by way of a specific example.

EXAMPLE

Equipment a. Cyclone 10-ten (10) inch diameter; the capacity is estimated to be fifteen (15) TPH feed solids operating at an inlet or feed pressure of 20 psi.

b. Micro-processor 20-Hewlett-Packard model HP85, manufactured by Hewlett-Packard Co.

c. Flow meters 16,22-magnetic flowmeter model 10D1416F, manufactured by Fischer and Porter Co.

d. Coil 18,24-Ramsey Coil model 30-21, manufactured by Ramsey Engineering Co.

e. Density gauge 26-Texas Nuclear model SGH, manufactured by Texas Nuclear Co.

Operation

The input or material feed to the cycone 10 can be expressed TPH (tons per hour) or GPM (gallons per minute). For such 10" diameter cyclone, the material feed from the several sources comprises:

water—46 TPH, (185 GPM)
non-magnetics—15 TPH, (45 GPM)
magnetite—25 TPH, (20 GPM)

Based on such breakdown of the material feed, a typical separating gravity for the cyclone is 1.40. However, during processing of the coal such separating gravity may change affecting the separation of the coal from the refuse. By the method of this invention, the separating gravity may be readily restored to the desired level.

For the 10" diameter cyclone of this Example, and from the operation data presented above, the feed input is 250 GPM. Consequently, the output between the overflow (clean coal) and underflow (refuse) totals 250 GPM. If the feed input includes 25 TPH of magnetite, then 25 TPH of magnetite will exit the cyclone in the overflow and underflow streams. The present invention is based on the recognition of a correlation between the magnetite in the overflow (or underflow) and the separating gravity of the cyclone. If the coil 18 shows, for example, that 20% or 5 TPH of magnetite is present in the overflow stream, a review of FIG. 2 will show that at 20% magnetite reporting to cyclone overflow the separating gravity of the cyclone will have increased slightly to about 1.41. The percent magnetite passing through coil 18 is continuously monitored and the appropriate data transmitted to microprocessor 20. If the separating gravity of the cyclone increases or decreases to an unacceptable level, microprocessor 20 will transmit a signal to the make-up valves 12 or 14 and a change in the feed will be made to reestablish the separating gravity to an acceptable level. For example, most of the magnetite fed to the cyclone will be of recirculated magnetite. Of the 25 TPH needed, approximately 24 TPH will enter the system through means 28. As a consequence, additional make-up magnetite and/or water must be added. However, the relative proportions of the additions may be changed to bring the separating gravity into line with the desired values.

Thus, by monitoring the percent magnetite in the overflow, for example, it is possible to automatically adjust the input feed to the cyclone to restore the separating gravity of the cyclone to the desired level to insure optimum separating conditions between the coal and refuse.

I claim:

1. In a continuous method of beneficiating coal from refuse type material having a different specific gravity than coal by the steps of subjecting said coal and refuse to the operation of a dense-media cyclone, in which the dense-media thereof is a slurry of magnetite and water, and the separating gravity of said dense-media is controlled within predetermined limits, including (1) withdrawing beneficiated coal and media from said cyclone in the form of an overflow, (2) withdrawing refuse and media from said cyclone in the form of an underflow, and (3) replenishing the dense-media slurry lost in the overflow and underflow by adding separate flows of magnetite and/or water to the cyclone, characterized by the improvement of controlling said separating gravity by the steps of (a) selecting a desired separating gravity under which the cyclone is to be operated;

(b) measuring the flow rate and percent magnetite in at least the stream of said overflow;

(c) changing the relative proportions of the feed flow of magnetite and/or water to said cyclone when the percent of measured magnetite corresponding to an actual separating gravity is different from that of a desired percent magnetite corresponding to said desired separating gravity as shown by the relationship of FIG. 2 to return the actual separating gravity to said desired separating gravity;

(d) continuously feeding untreated coal and refuse for treatment hereby to said cyclone.

2. The method according to claim 1 wherein a portion of the magnetite from the overflow and underflow is recovered and recycled into said cyclone.

* * * * *